US008008994B2

(12) United States Patent
Reddy et al.

(10) Patent No.: US 8,008,994 B2
(45) Date of Patent: Aug. 30, 2011

(54) TUNABLE CAPACITIVE INPUT COUPLING

(75) Inventors: Raja K. Reddy, Meriden, CT (US); Yin-Shing Chong, Meriden, CT (US); Teppo M. Lukkarila, Meridan, CT (US); Michael Joseph Adkins, Fruitland, MD (US)

(73) Assignee: Alcatel Lucent, Paris (FR)

( * ) Notice: Subject to any disclaimer, the term of this patent is extended or adjusted under 35 U.S.C. 154(b) by 223 days.

(21) Appl. No.: 12/434,432

(22) Filed: May 1, 2009

(65) Prior Publication Data

US 2010/0277258 A1 Nov. 4, 2010

(51) Int. Cl.
*H01P 1/20* (2006.01)
*H01P 7/06* (2006.01)

(52) U.S. Cl. ..... 333/202; 333/230; 333/235

(58) Field of Classification Search ..... 333/202, 333/203, 219, 219.1, 230, 332, 229, 234
See application file for complete search history.

(56) References Cited

U.S. PATENT DOCUMENTS

| | | | | |
|---|---|---|---|---|
| 4,380,747 | A * | 4/1983 | Curtinot et al. | 333/202 |
| 4,890,078 | A * | 12/1989 | Radcliffe | 333/134 |
| 4,980,662 | A * | 12/1990 | Simon et al. | 333/134 |
| 5,023,579 | A * | 6/1991 | Bentivenga et al. | 333/203 |
| 6,362,708 | B1 * | 3/2002 | Woods | 333/234 |
| 6,542,049 | B2 * | 4/2003 | Henningsson et al. | 333/132 |
| 6,664,872 | B2 * | 12/2003 | Channabasappa et al. | 333/202 |
| 7,439,830 | B2 * | 10/2008 | Kich | 333/234 |

* cited by examiner

*Primary Examiner* — Seungsook Ham
(74) *Attorney, Agent, or Firm* — Kramer & Amado P.C.

(57) ABSTRACT

Various exemplary embodiments include a cavity having a tuning assembly with tunable capacitive coupling. The tuning assembly may have a recess having a specified depth, designed for a default magnitude of coupling into the cavity. A sleeve may be fully inserted within the recess to have the structure operate at that default coupling magnitude. If a different amount of coupling is desired, the sleeve may be inserted to a particular depth that only includes part of the recess, enabling repeatable tuning of a plurality of cavities.

20 Claims, 4 Drawing Sheets

TUNABLE CAPACITIVE INPUT COUPLING

TECHNICAL FIELD

Various exemplary embodiments relate generally to capacitive input coupling and, more particularly, to tuning a capacitive input coupler.

BACKGROUND

Many systems use cavity filters to define resonant frequencies for microwave or radio frequency (RF) signals. Such cavities may have an enclosed space surrounded by at least one electrically conductive wall. The dimensions of this enclosed space and the interaction of the electromagnetic waves that embody the signals with the at least one electrically conductive wall define particular frequencies.

A cavity filter is not useful without means for coupling energy into the cavity and from the cavity, so a coupler may be added to transfer a portion of the energy from the cavity filter to an external location. A simple coupler could be a direct metal to metal connection, such that the coupler directly taps energy from the conductive walls of the cavity.

However, such DC-grounded tapping has a number of drawbacks. For example, due to non-linearity in the electromagnetic waves at the metal-to-metal contacts, Passive Inter-Modulation (PIM) signals may appear when signals pass from the cavity walls into a conductive junction. Such degradation in performance is particularly likely when a conductive wall of a cavity is directly linked to a metallic coupler. PIM signals raise a number of issues, including distortion of a desired signal that may potentially degrade system performance.

PIM may be avoided, to some extent, by high quality workmanship, such that the metallic conductor is precisely soldered to a cavity wall. However, even one skilled in metallurgy may be unable to perfectly shape the junction, so some PIM signals will persist. Thus, an alternative solution may be needed that does not involve a metal-to-metal junction.

One alternative is to place a dielectric between the metallic wall of the cavity and the external conductor. Fixed capacitive tapping may use a coaxial structure. However, such a structure is not easily tunable, so it can only tap a set amount of energy from a cavity filter.

Another conventional method requires insertion of tuning screws into a microwave cavity. While rotating a screw to vary the depth of its penetration into the cavity does achieve tuning, it may be difficult to duplicate such tuning when the environment requires adjustment of a very large coupling range with a single design. Thus, it would be beneficial to have a tuning technique for a cavity that was repeatable, resulting in identical coupling each time the technique was used in the same way in a cavity having the same dimensions.

For the foregoing reasons and for further reasons that will be apparent to those of skill in the art upon reading and understanding this specification, there is a need for a capacitive coupling technique that is both easily tunable and adequately reduces PIM.

SUMMARY

In light of the present need for an improved technique for capacitive coupling from a cavity filter, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

In various exemplary embodiments, a filter may provide tunable capacitive input coupling, the filter including one or more of the following: a housing having at least one conductive wall that defines a cavity operating at a default frequency; a conductive element extending inside the cavity from the at least one conductive wall along an axis; and a tuning assembly disposed adjacent the at least one conductive wall and separated from the conductive element by a tunable distance. The tuning assembly may include: a hollow sleeve inserted into a recess having a specified depth along the at least one conductive wall parallel to the axis, the hollow sleeve comprising a non-conductive material and having a particular depth; a wire having a first end inserted fully within the hollow sleeve to the particular depth and a second end bent in a direction orthogonal to said axis, thereby having the capacitive input coupling fixed to a value that is proportional to the particular depth; and a dielectric disposed circumferentially around the first end of the wire, the dielectric retaining the first end of the wire within the hollow sleeve at the particular depth.

In addition, in various exemplary embodiments, the particular depth may be determined through manual testing. Furthermore, in various exemplary embodiments, the wire may be L-shaped, having a bend so that the first end and the second end are orthogonal.

In various exemplary embodiments, the cavity may have a rectangular shape. Alternatively, the cavity may have a cylindrical shape. In various exemplary embodiments, the conductive element may have a cylindrical shape.

In various exemplary embodiments, the dielectric may compress the first end of the wire, thereby holding the wire in a fixed position. In various exemplary embodiments, the specified depth of the hollow sleeve may correspond to a default level of capacitive coupling for the cavity and the default frequency of the cavity.

In various exemplary embodiments, the sleeve may be inserted to the particular depth to tune a cavity to operate at a new level of coupling different from the default coupling, the particular depth being less than the specified depth. In various exemplary embodiments, the sleeve may further comprise a locking portion, the locking portion protruding outside of the recess and holding the sleeve in a fixed position within the recess.

In various exemplary embodiments, a tuning assembly may comprise: a hollow sleeve inserted into a recess having a specified depth along the at least one conductive wall parallel to an axis, the hollow sleeve comprising a non-conductive material and having a particular depth; a wire having a first end fully inserted within the hollow sleeve to the particular depth and a second end bent in a direction orthogonal to said axis, thereby having the capacitive input coupling fixed to a value that is proportional to the particular depth; and a dielectric disposed circumferentially around the first end of the wire, the dielectric retaining the first end of the wire within the hollow sleeve at the particular depth.

In various exemplary embodiments, the particular depth may be determined through manual testing. In various exemplary embodiments, the wire may be L-shaped, having a bend so that the first end and the second end are orthogonal.

In various exemplary embodiments, the dielectric may compress the first end of the wire, thereby holding the wire in a fixed position. In various exemplary embodiments, the specified depth of the recess may correspond to a default level of capacitive coupling.

In various exemplary embodiments, the sleeve may be inserted to the particular depth to tune a cavity to operate at a new level of coupling different from the default coupling, the particular depth being less than the specified depth. In various exemplary embodiments, the sleeve may further comprise a locking portion, the locking portion protruding outside of the recess and holding the sleeve in a fixed position within the recess.

In various exemplary embodiments, a method of assembling a filter includes one or more of the following steps: providing a housing with at least one conductive wall that defines a cavity; placing a conductive element within the cavity, the conductive element mounted on the at least one conductive wall and extending from the at least one conductive wall into the cavity along an axis; mounting a tuning assembly on the at least one conductive wall, the tuning assembly separated from the conductive element and having an internal recess with a specified depth parallel to the axis; inserting a non-conductive sleeve into the internal recess to a particular depth; inserting a first end of a wire fully into the sleeve to the particular depth, the wire having a second end bent in a direction orthogonal to the axis; and placing a dielectric around the first end of the wire to maintain the wire at the particular depth in the sleeve, thereby defining a tuned distance for capacitive coupling between the wire and the conductive element.

In various exemplary embodiments, the method may further comprise performing manual testing to determine the particular depth. In various exemplary embodiments, the method may further comprise inserting the sleeve to the particular depth to tune the cavity to operate at a new coupling different from a default coupling, the particular depth being less than the specified depth.

BRIEF DESCRIPTION OF THE DRAWINGS

In order to better understand the various exemplary embodiments, reference is made to the accompanying drawings, wherein.

DETAILED DESCRIPTION

Figure 1:
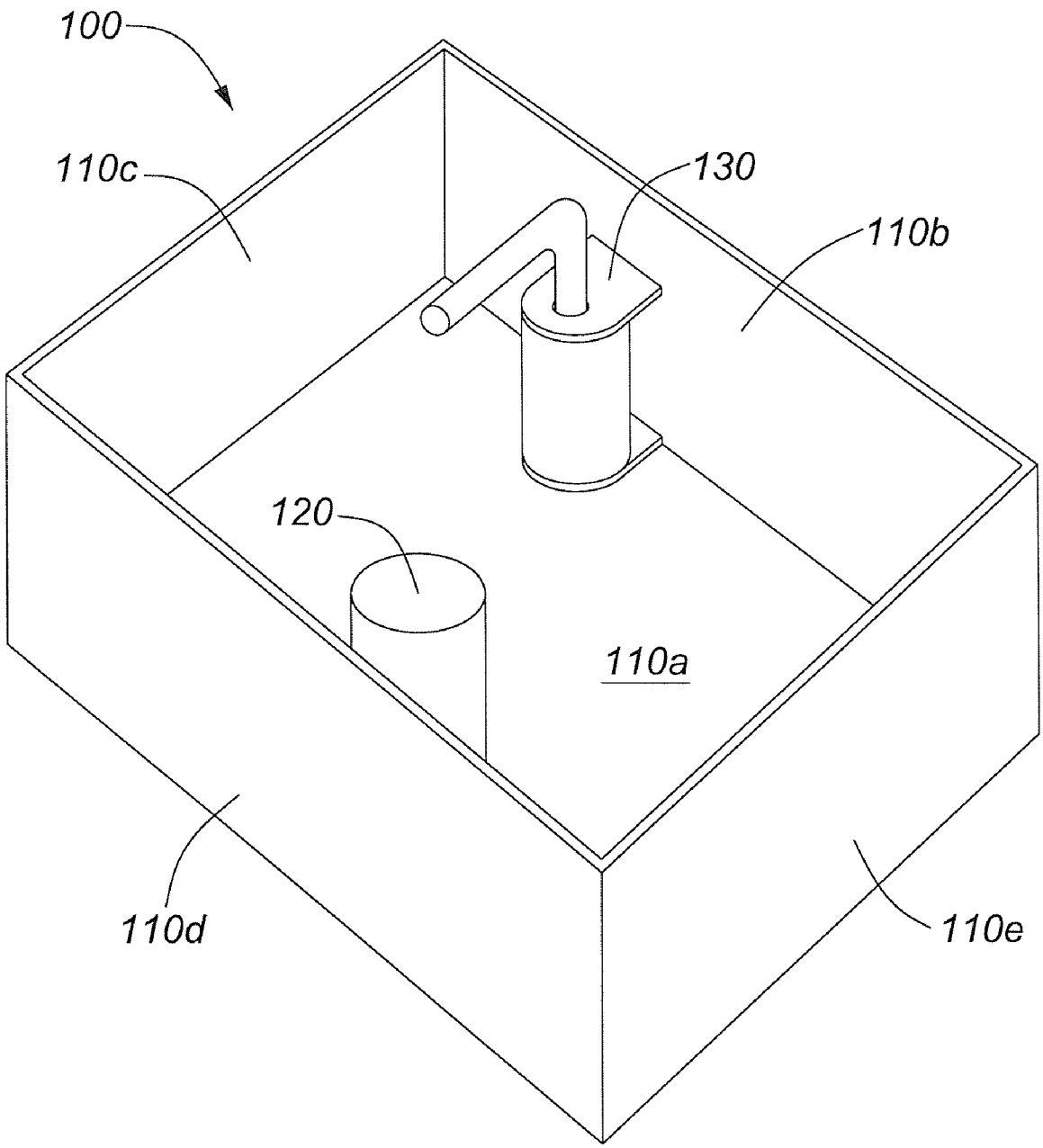
FIG. 1 is a perspective view of an exemplary cavity filter.

Referring now to the drawings, in which like numerals refer to like components or steps, there are disclosed broad aspects of various exemplary embodiments.

FIG. 1 is a perspective view of an exemplary cavity filter 100. In various exemplary embodiments, filter 100 may include a housing having a bottom portion 110*a*, and four side walls 110*b*, 110*c*, 110*d*, and 110*e*. In operation, the housing may also have a top portion (not shown), but the top portion is absent in FIG. 1 to permit a view of the interior of filter 100. Bottom portion 110*a*, four side walls 110*b*, 110*c*, 110*d*, and 110*e*, and the top portion may all be made of conductive material, such as metal.

As depicted in FIG. 1, filter 100 may be a cavity defined by its conductive walls in the shape of a rectangular solid. However, other suitable shapes will be apparent to those of skill in the art. For example, filter 100 could have a single side wall to define a cylindrical cavity. A cavity with only one wall might have a spherical spheroidal, or ellipsoidal shape. In general, filter 100 has at least one conductive wall defining a cavity that confines electromagnetic waves.

Filter 100 also has a conductive element 120 extending orthogonally from bottom portion 110*a* into the cavity. In FIG. 1, conductive element 120 is shown as a cylindrical post, but conductive element 120 may be designed to have other shapes, as will be apparent to one having ordinary skill in the art. Conductive element 120 may also act as a source for subsequent transfer of electrical energy.

Tuning assembly 130 may be disposed along one side wall 110*b* of the cavity. Although tuning assembly 130 does not physically touch conductive element 120, it has a virtual connection due to capacitive coupling. As will be described in greater detail below, a designer may vary the distance between conductive element 120 and tuning assembly 130 to change the amount of capacitive coupling.

Figure 2:
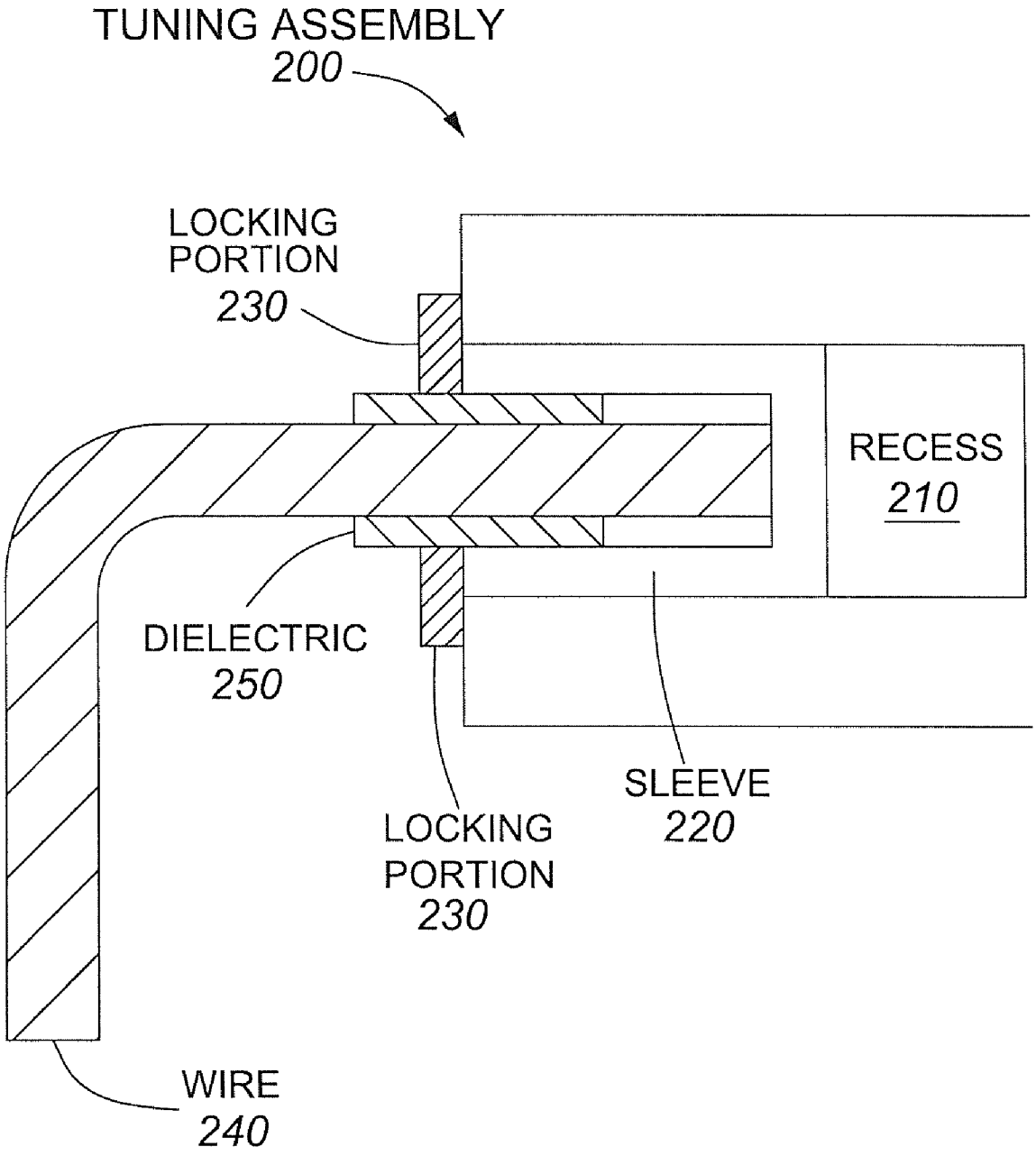
FIG. 2 is a sectional view of an exemplary tuning assembly within the filter of FIG. 1.

While tuning assembly 130 may be disposed in a corner of a filter, as shown in FIG. 2, tuning assembly 130 may be placed in any appropriate place for capacitive coupling in the filter 100 of FIG. 1, as will be apparent to one of ordinary skill in the art. The position of tuning assembly 130 within the cavity may permit the distance between tuning assembly 130 and conductive element 120 to be precisely measured.

FIG. 2 is a sectional view of an exemplary tuning assembly 200 within the filter 100 of FIG. 1. In various exemplary embodiments, tuning assembly 200 may comprise a recess 210, a sleeve 220, a locking portion 230, a wire 240, and a dielectric 250. Tuning assembly 200 may be disposed on a corner of a rectangular cavity, as depicted in FIG. 2, but its position may be varied to other locations within a cavity resonator, as will be apparent to those having ordinary skill in the art.

During manufacture, tuning assembly 200 is fabricated with a hollow recess 210. Recess 210 may be cylindrical in shape, but other shapes may be applicable, as will be apparent to those having ordinary skill in the art. The specified depth of recess 210 should be designed for subsequent tuning of a cavity resonator.

Sleeve 220 fits into recess 210 within tuning assembly 200. Sleeve 220 may be pushed fully into recess 210, corresponding to a specified depth set during manufacture, or sleeve 220 may be inserted only to a particular depth within the recess. This procedure may permit repeated use of identical sleeves 220 in cavities to produce similar coupling characteristics.

Sleeve 220 may be fabricated from a non-conductive material, such as Teflon™. Sleeve 220 may also be cylindrical in shape, having a long axis that is parallel to the long axis of conductive element 120, as depicted in FIG. 1. Such alignment is exemplary and may keep sleeve 220 at a constant distance from conductive element 120. However, sleeve 220 may be shaped differently, matching the contour of recess 220, as will be apparent to those having ordinary skill in the art.

Locking portion 230 may ensure that sleeve 220 only reaches a predetermined depth within recess 210. Exemplary locking portion 230, as depicted in FIG. 2, may comprise two tabs that extend beyond the perimeter of recess 210. Locking portion 230 may be integral with sleeve 220. In this case, sleeve 220 may be shaped somewhat like a mushroom, having a thin stem portion within recess 210 and thicker locking portion 230 protruding outside of recess 210 to hold sleeve 220 in position at a particular depth within recess 210. The particular shape of locking portion 230 may vary, as will be apparent to those having ordinary skill in the art, but locking portion 230 should be manufactured to secure sleeve 220 solidly within recess 210.

A designer may wish to change the coupling from its default level. The default level of capacitive coupling corresponds to the specified depth of recess 210. Thus, a designer would create a sleeve 220 having a particular depth, using manual testing to determine if that particular depth was appropriate for the desired operating frequency of the resonant cavity. This depth may be specified by determining the proper location of locking portion 230 along sleeve 220.

Wire 240 may be L-shaped, bent so that a first end of wire 240 fits securely within sleeve 220. A second end of wire 240 may form a right angle, extending orthogonally toward element 120, as depicted in FIG. 1. Wire 240 may be fully inserted into sleeve 220 at the particular depth, thereby defining a constant distance between the second end of wire 240 and conductive element 120.

A specified depth of sleeve 220 may correspond to a particular level of capacitive coupling designed for a cavity. Therefore, a manufacturer may design a plurality of cavities to have identical sleeves, thereby ensuring that those sleeves 220 may produce a default coupling within the cavities when wire 240 is fully inserted into those sleeves 220. However, it should be apparent to those skilled in art that such determination of an appropriate depth for sleeve 220 may be determined at times other than manufacture. For example, sleeve 220 could be adjusted prior to installation of the cavities in a work environment.

In either case, the designer will have flexibility to insert sleeve 220 firmly into recess 210 in tuning assembly 200. Inserting sleeve 220 further into recess 210 may increase the distance between the second end of wire 240 and conductive element 120, thereby reducing the capacitive coupling. Conversely, withdrawing sleeve 220 from recess 210 may decrease the distance between the second end of wire 240 and conductive element 120, strengthening the capacitive coupling.

Dielectric 250 may surround the first end of wire 240. Dielectric 250 may be fabricated from a non-conductive plastic, such as polyethylene terephthalate (PET). When wire 240 is inserted into sleeve 220, sleeve 220 may exert a compression force on wire 240 and dielectric 250, thereby holding wire 240 in a fixed position within sleeve 220. This fixed position may be the position at which wire 240 and dielectric 250 are inserted completely into sleeve 220, such that the depth of wire 240 is at the particular depth of sleeve 220 within recess 210.

Wire 240 may pass directly through a central axis of dielectric 250, being aligned with the middle of sleeve 220. However, it should be apparent to those skilled in the art that wire 240 may be disposed in other positions. Regardless of the actual location of wire 240 relative to dielectric 250, dielectric 250 should firmly hold wire 240 in place after it has been moved to an appropriate position in sleeve 220. Thus, locking portion 230 may encompass or otherwise engage the outer perimeter of recess 210, locking both sleeve 220 and dielectric 250 into recess 210 at a particular depth.

Figure 3:
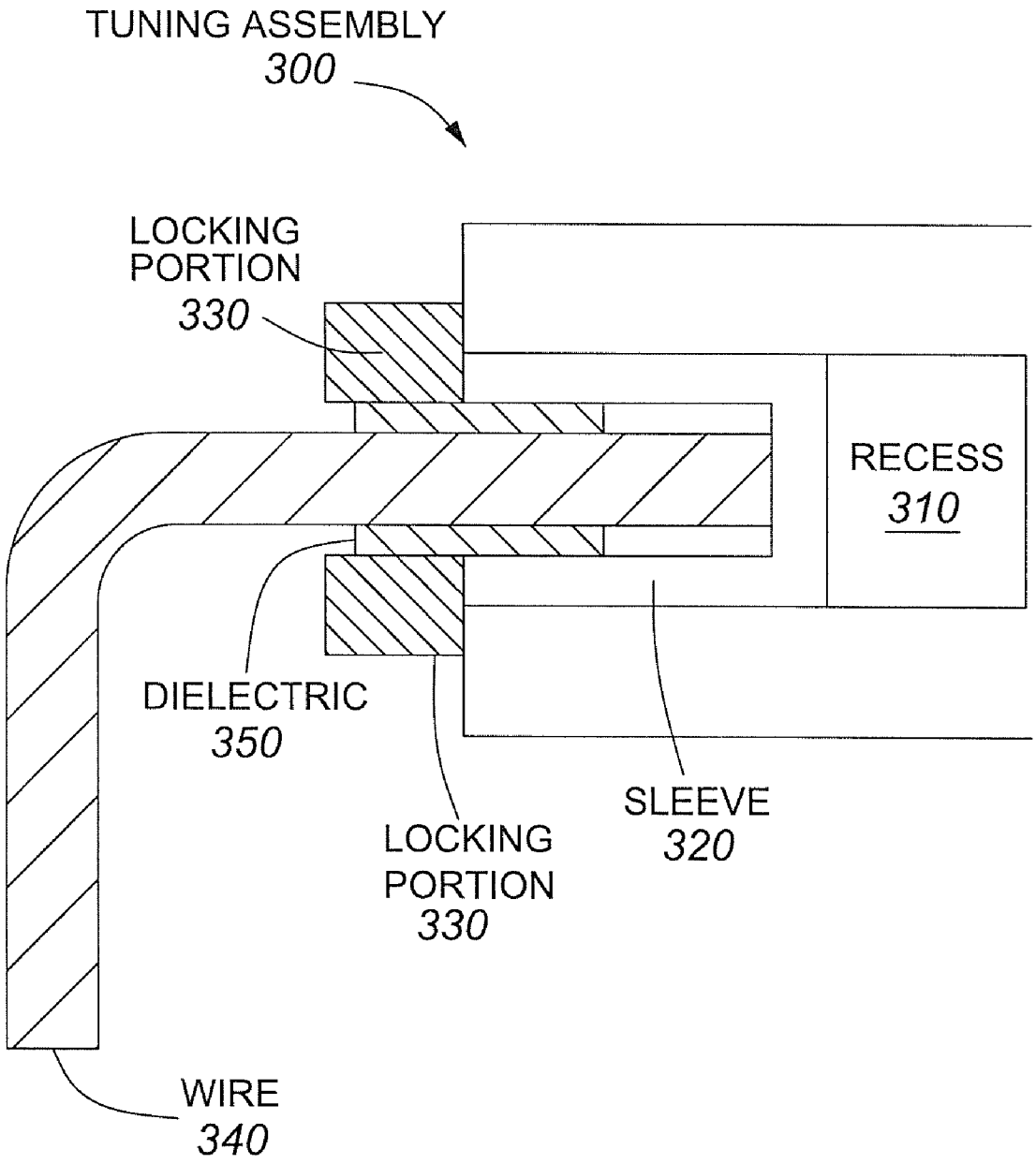
FIG. 3 is a detailed view of the tuning assembly of FIG. 2, showing partial removal of a sleeve from a recess in the exemplary tuning assembly.

FIG. 3 is a detailed view of tuning assembly 300, showing partial removal of sleeve 320 from recess 310 in tuning assembly 300. During manual testing, a designer may discover that the capacitive coupling is insufficient. In such a case, sleeve 320 may be built so that it only fills part of recess 310, reaching a particular depth instead of the specified depth of recess 310.

The designer may perform testing when creating sleeve 320 to correlate the shape of sleeve 310 to the desired capacitive coupling. Locking portion 330 may prevent sleeve 320 from being inserted beyond a particular depth in recess 310. Dielectric 350 may prevent wire 340 from wobbling within sleeve 320. Dielectric 350 may fill all space between wire 340 and sleeve 320 or only part of that space.

Figure 4:
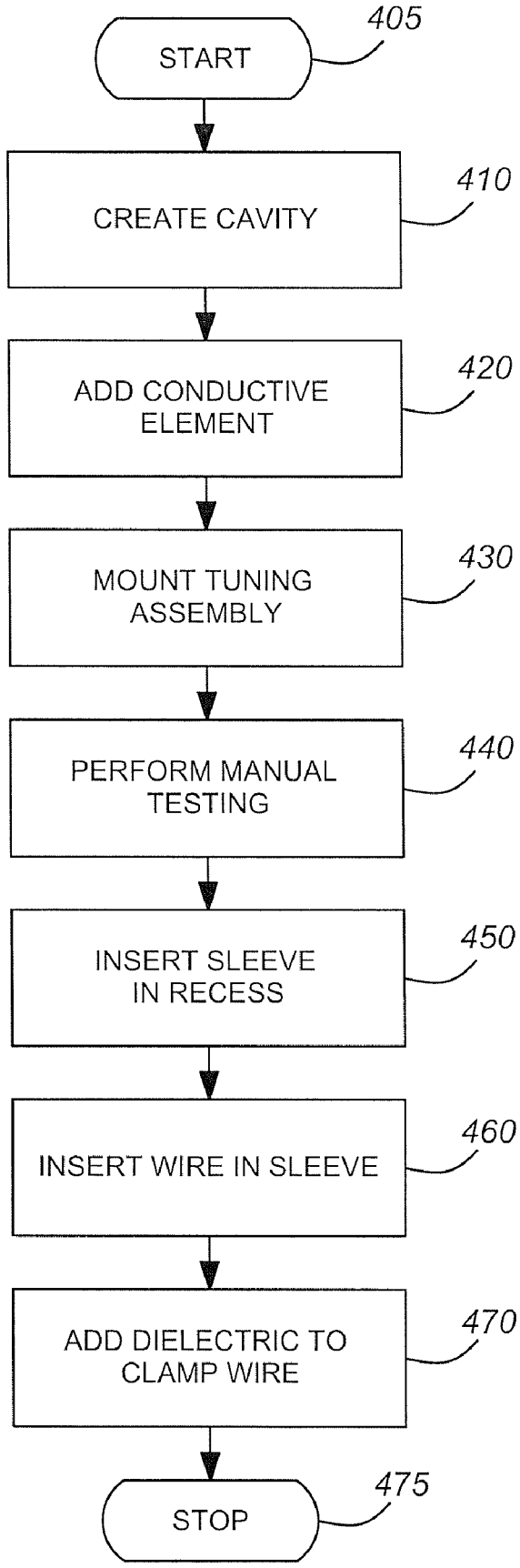
FIG. 4 is a flowchart for a method of assembling a cavity filter with a tuning assembly for capacitive coupling.

FIG. 4 is a flowchart for a method 400 of assembling a cavity filter with a tuning assembly for capacitive coupling. The method starts in step 405 and proceeds to step 410. In step 410, the designer provides a housing having at least one conductive wall that defines a cavity. The wall may be metallic. The cavity may be shaped as a cube, a rectangular cuboid, or a parallelepiped.

In step 420, the designer places a conductive element within the cavity and mounts the conductive element on a wall so that it extends from that wall into the cavity along an axis. The conductive element may, for example, have the shape of a cylindrical post. Like the wall, the conductive element may be made of metal.

In step 430, the designer mounts a tuning assembly on the wall, the tuning assembly being separated from the conductive element and having an internal recess parallel to the axis. The tuning assembly may be cylindrical in shape. The recess may have a specified depth based upon default capacitive coupling levels.

In step 440, manual testing may be performed to determine a particular depth for insertion of the sleeve into the recess. The sleeve may be cylindrical in shape. The sleeve may entirely fill the recess to obtain the default level of capacitive coupling. Alternatively, the designer may shape the sleeve so that it only fills the recess to a particular depth, performing testing to make sure that the sleeve is shaped to match this target.

In step 450, the designer inserts the sleeve into the recess once testing is finished. The locking portion of the sleeve, which may be constructed to match the contour of the outer perimeter, will engage once the sleeve is inserted to the particular depth within the recess having the specified depth. Because the locking portion is wider than the width of the recess, the locking portion will prevent any further insertion, locking the sleeve to the particular depth within the recess.

In step 460, the designer fully inserts a first end of a wire into the sleeve to a particular depth. The wire may have a second end bent in a direction orthogonal to the axis. The wire is fully inserted until it reaches the end of the sleeve. At this point, the locking portion of the sleeve ensures that the wire and the sleeve cannot be pushed any further into the recess, fixing both at their current positions.

In step 470, a dielectric is placed around the first end of said wire to maintain the wire at the particular depth in the sleeve, thereby defining a tuned distance for capacitive coupling between the wire and a conductive element. The method ends in step 475.

Thus, according to the foregoing, various exemplary embodiments provide a reliable and efficient method for capacitively coupling energy into or from a cavity filter. More particularly, the various exemplary embodiments provide a technique for tuning capacitive coupling in a reliable manner.

It should be apparent that the foregoing description of a cavity filter is only exemplary. Thus, the teachings of this disclosure are equally applicable to any system where selection of a particular frequency is important. For example, the teachings of this disclosure could be applied to any system that transfers electrical energy in a capacitive manner. Other suitable substitutes will be apparent to those of ordinary skill in the art.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications may be implemented while remaining within the spirit and scope of the invention. Accordingly, the foregoing disclosure, description, and figures are for illustrative purposes only and do not in any way limit the invention, which is defined only by the claims.

What is claimed is:

1. A filter that provides tunable capacitive coupling, the filter comprising:

a housing having at least one conductive wall that defines a cavity operating at a default frequency;

a conductive element extending inside said cavity from said at least one conductive wall along an axis; and a tuning assembly disposed adjacent said at least one conductive wall and separated from said conductive element by a tunable distance, said tuning assembly comprising:

a hollow sleeve inserted into a recess having a specified depth along said at least one conductive wall and parallel to said axis, said hollow sleeve comprising a non-conductive material and having a particular depth, a wire having a first end inserted fully within said hollow sleeve to said particular depth and a second end bent in a direction orthogonal to said axis, thereby having said capacitive coupling fixed to a value that is proportional to said particular depth, and a dielectric disposed circumferentially around said first end of said wire, said dielectric retaining said first end of said wire within said hollow sleeve at said particular depth.

2. The filter of claim 1, wherein said particular depth is determined through manual testing.

3. The filter of claim 1, wherein said wire is L-shaped, having a bend so that said first end and said second end are orthogonal.

4. The filter of claim 1, wherein said cavity has a rectangular shape.

5. The filter of claim 1, wherein said cavity has a cylindrical shape.

6. The filter of claim 1, wherein said conductive element has a cylindrical shape.

7. The filter of claim 1, wherein said sleeve compresses said dielectric and said first end of said wire, thereby holding said wire in a fixed position.

8. The filter of claim 1, wherein said specified depth of said recess corresponds to a default level of capacitive coupling for said cavity and said default frequency of said cavity.

9. The filter of claim 1, wherein said sleeve is inserted to said particular depth to tune said cavity to operate at a new frequency different from said default frequency, said particular depth being less than said specified depth.

10. The filter of claim 1, said sleeve further comprising:

a locking portion, said locking portion protruding outside of said recess and holding said sleeve in a fixed position within said recess.

11. A tuning assembly comprising:

a hollow sleeve inserted into a recess having a specified depth along said at least one conductive wall parallel to an axis, said hollow sleeve comprising a non-conductive material and having a particular depth;

a wire having a first end fully inserted within said hollow sleeve to said particular depth and a second end bent in a direction orthogonal to said axis thereby having a capacitive coupling fixed to a value that is proportional to said particular depth; and a dielectric disposed circumferentially around said first end of said wire, said dielectric retaining said first end of said wire within said hollow sleeve at said particular depth.

12. The tuning assembly of claim 11, wherein said particular depth is determined through manual testing.

13. The tuning assembly of claim 11, wherein said wire is L-shaped, having a bend so that said first end and said second end are orthogonal.

14. The tuning assembly of claim 11, wherein said dielectric compresses said first end of said wire, thereby holding said wire in a fixed position.

15. The tuning assembly of claim 11, wherein said specified depth of said recess corresponds to a default level of capacitive coupling.

16. The tuning assembly of claim 11, wherein said sleeve is inserted to said particular depth to tune a cavity to operate at a new frequency different from said default frequency, said particular depth being less than said specified depth.

17. The tuning assembly of claim 11, the sleeve further comprising:

a locking portion, said locking portion protruding outside of said recess and holding said sleeve in a fixed position within said recess.

18. A method of assembling a filter, said method comprising:

providing a housing with at least one conductive wall that defines a cavity;

placing a conductive element within said cavity, said conductive element mounted on said at least one conductive wall and extending from said at least one conductive wall into said cavity along an axis;

mounting a tuning assembly on said at least one conductive wall, said tuning assembly separated from said conductive element and having an internal recess with a specified depth parallel to said axis;

inserting a non-conductive sleeve into said internal recess to a particular depth;

inserting a first end of a wire fully into said sleeve to said particular depth, said wire having a second end bent in a direction orthogonal to said axis; and placing a dielectric around said first end of said wire to maintain said wire at said particular depth in said sleeve, thereby defining a tuned distance for capacitive coupling between said wire and said conductive element.

19. The method of claim 18, said method further comprising:

performing manual testing to determine said particular depth.

20. The method of claim 18, said method further comprising:

inserting said sleeve to said particular depth to tune said cavity to operate at a new frequency different from a default frequency, said particular depth being less than said specified depth.

* * * * *